United States Patent [19]

Bretz et al.

[11] 4,453,861

[45] Jun. 12, 1984

[54] TRENCH WALLS AND METHOD FOR CONSTRUCTING SAME

[75] Inventors: Helmut Bretz, Munich; Hubert Eberle, Gräfelfing, both of Fed. Rep. of Germany

[73] Assignee: Firma Josef Riepl Bau-AG, Munich, Fed. Rep. of Germany

[21] Appl. No.: 202,872

[22] Filed: Oct. 31, 1980

[30] Foreign Application Priority Data

Nov. 2, 1979 [DE] Fed. Rep. of Germany ..... 2944385

[51] Int. Cl.[3] ..... E02D 5/20

[52] U.S. Cl. ..... 405/267; 405/287

[58] Field of Search ..... 405/267, 272, 282, 287; 52/742; 249/10; 264/31, 35

[56] References Cited

U.S. PATENT DOCUMENTS 3,820,344 6/1974 Caron et al. ..... 405/267

4,005,582 2/1977 Tamaro ..... 405/267

FOREIGN PATENT DOCUMENTS 2133081 2/1972 Fed. Rep. of Germany ..... 405/267

59741 1/1968 German Democratic Rep. ..... 405/267

*Primary Examiner*—David H. Corbin

*Attorney, Agent, or Firm*—James E. Nilles

[57] ABSTRACT

A trench wall section having a finished exposed surface and a method for constructing such a trench wall section involves excavating a trench and simultaneously filling it with shore-up fluid, inserting into the trench a pair of spaced apart vertical partition elements having guide grooves thereon, engaging the ends of a prefabricated plate with the guide grooves and guiding the plate downward into the trench between the vertical partition elements at the side of the trench wall which is later to be exposed by removing the soil, introducing in-situ concrete into the space between the plate and the other side of the trench and between the vertical partition elements and thereby displacing the shore-up fluid, allowing the in-situ concrete to harden into a body which adheres to the plate and to the vertical partition elements, and removing the soil to expose the plate, the associated vertical partition elements and the concrete body which are joined together to form the trench wall section.

5 Claims, 6 Drawing Figures

TRENCH WALLS AND METHOD FOR CONSTRUCTING SAME

DESCRIPTION

Figure 1:
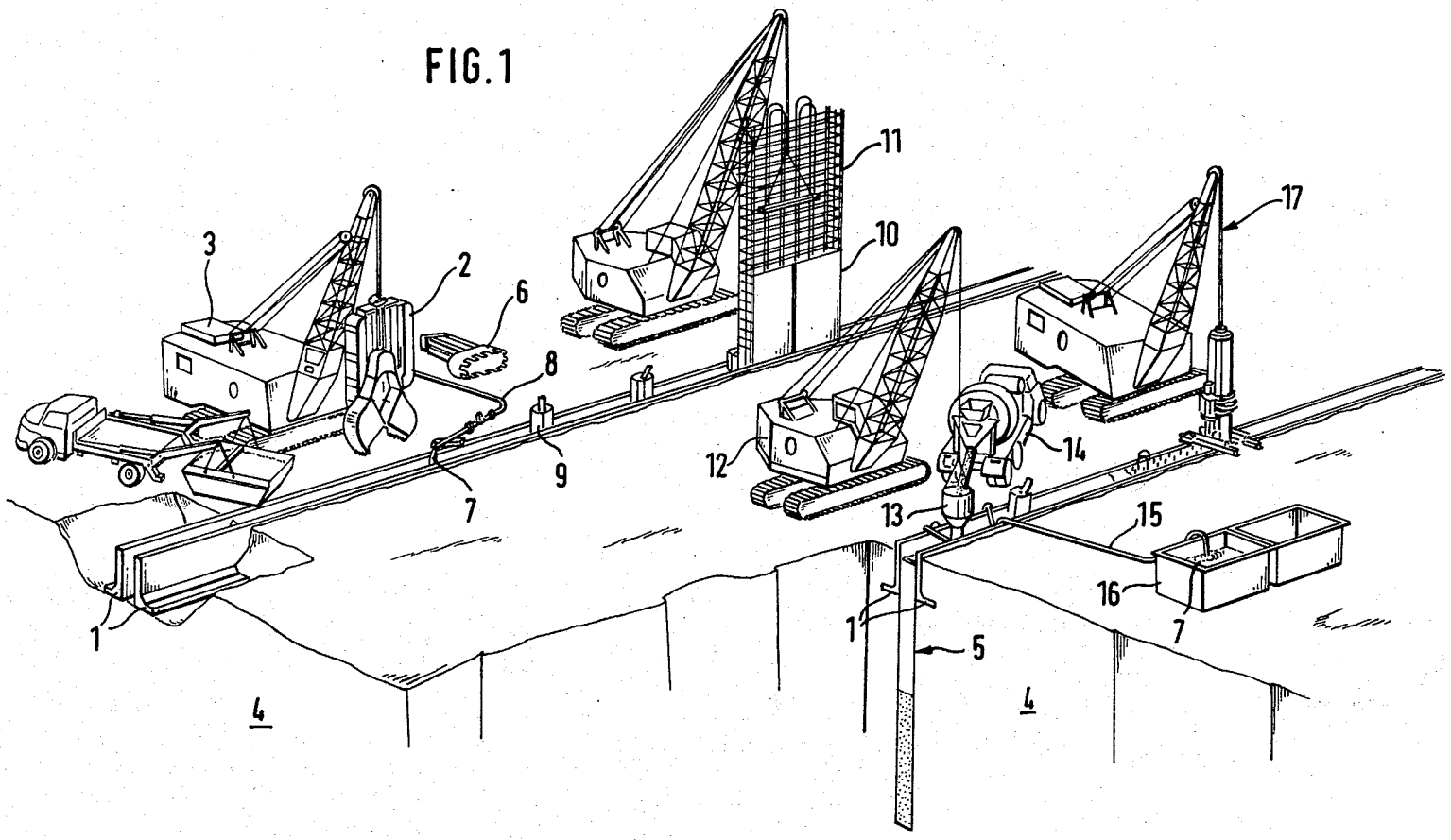

This invention relates to a method for constructing trench walls, wherein a trench is excavated in the soil, simultaneously filled with a shore-up fluid, and subsequently filled with in-situ concrete displacing said shore-up fluid.

Trench walls are generally employed at sites whereat a building is to be erected within or above the ground. In this application the trench wall enables the underground structure to be erected by shoring up the surrounding soil. Frequently, the finished trench wall is employed as the peripheral wall of the building. To this effect, the soil is removed at one side of the finished trench wall, so that the latter has then an exposed visible side facing towards the interior of the building and an outer side facing the surrounding ground.

Under certain geological conditions of the soil, for instance in the case of gravel or other loose components tending to slip or to cave in during excavation, the introduction of the in-situ concrete may not result in the formation of a smooth trench wall, inasmuch as such slippage cavities will also be filled with the concrete. A desired smooth surface at the exposed side of the wall will then require additional finishing work, resulting in increased cost.

It is an object of the present invention to provide a method of the type defined in the introduction, by the employ of which it is possible to erect trench walls having substantially smooth exposed surfaces even under difficult geological conditions.

In order to attain this object, the invention provides that prior to introducing the in-situ concrete, at least one prefabricated plate is located at the side of the trench wall later to be exposed by removing the soil, the in-situ concrete being subsequently introduced into the space between said plate and the other side of said trench.

The method according to the invention is simple and economical. Even if cavities are formed in the excavated trench, the prefabricated plates lowered into the trench permit to obtain a trench wall having a substantially smooth exposed surface. The plates, thus perform two functions, namely, that of forming the exposed surface of the trench wall with its outer side, and that of forming a shuttering surface for the in-situ concrete with its inner side, so that the concrete is substantially prevented from flowing into the cavities. Even if some of the concrete leaks through between adjacent plates, such leakage results in the beneficial effect that the leaked concrete contributes to the compensation of the pressure exerted by the concrete on the inner side of the plate, thus reducing the overall load on the plates during introduction of the in-situ concrete. As a matter of fact, the leaked concrete has to be removed afterwards. This requires considerably less effort, however, than in the absence of the prefabricated plates.

To facilitate the removal of the leaked concrete, the exposed side of the plate may be coated with a release agent prior to being installed.

The prefabricated plate may be formed of various materials, e.g. concrete, artificial or natural stone, asbestos concrete etc. The plates are essentially thin, their thickness being selected so as to withstand the loads thereon during installation.

To facilitate their handling during installation, the plates may be connected to the reinforcement provided for the trench wall. In the construction of trench walls it is customary to lower so-called reinforcement cages into the trench prior to the filling thereof, from bottom to top, with the in-situ concrete. The plates can be readily affixed to such reinforcement cages or other reinforcements, it being possible to affix a plurality of plates to one such reinforcement cage. The thus formed unit may then be lowered into the trench in a controlled manner. It is to be noted, however, that the plates may also be installed without being connected to a reinforcement.

Trench walls are customarily erected with the aid of vertical partition elements dividing the trench into adjacent sections. The individual sections between adjacent partition elements are then consecutively filled with the in-situ concrete. The length of said sections may be selected so as to correspond to the length of the plates or a multiple thereof.

In the building art it is also known to erect trench walls from prefabricated concrete elements throughout. The thickness of the concrete elements substantially corresponds to that of the finished trench wall, the latter being subsequently sealed by introducing a filler material into the joints between adjacent elements.

This known method suffers from the disadvantage that the concrete elements have to be prefabricated in uniform sizes for economical reasons. The size of the prefabricated concrete elements determines the dimensions and configuration of the structure to be erected, since it is scarcely worth while to shorten or otherwise to reduce the size of the concrete elements for adaptation to a desired configuration of the trench wall.

The size of prefabricated concrete elements is moreover limited by considerations as to their weight. Depending on the equipment, e.g. excavators, employed for installing the prefabricated elements, the weight thereof may not exceed a predetermined limit, as the installation would otherwise by greatly hampered.

In comparison to the above described known method, the method according to the invention offers the advantage of being variable as concerns the adaptation of the trench wall to be erected to any desired configuration and/or depth. This means that the method according to the invention combines the advantages of the prefabricated element method with those of the in-situ concrete method, without the necessity to cope with the drawbacks of the two methods. In the method according to the invention, the erection of the load-bearing parts from in-situ concrete offers the advantage that the depth and the amount of reinforcement can be readily adapted to local conditions. The employ of prefabricated plates for forming the exposed surface of the trench wall offers the advantage of obtaining a smooth surface without the necessity of expensive finishing work.

If the trench wall is erected in consecutive sections separated from one another by vertical partition elements, an advantageous embodiment of the invention provides that the plates are guided by guide means provided at said partition elements while being lowered to the depth of the trench. In this manner, the partition elements are employed for aligning the plates.

A further object of the invention is the provision of a partition element for vertically separating adjacent sections of a trench wall from one another. In view of this object the invention provides that the partition element comprises guide means for guiding prefabricated plates during the lowering thereof to their installation site. In an advantageous embodiment, the partition element may have a substantially rectangular cross-sectional configuration, said guide means being provided along opposite corner regions of at least one of the shorter sides of the rectangle.

The guide means are advantageously formed as grooves. As an alternative, they may be formed by profile elements fixedly attached to the partition element for locking and longitudinally slidable engagement with engagement members carried by the plates.

Figure 2:
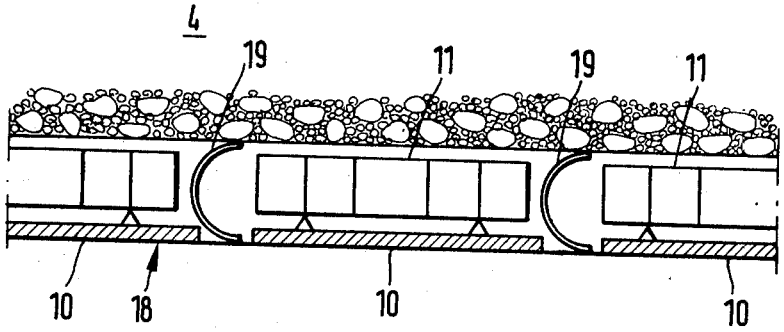
Figure 3:
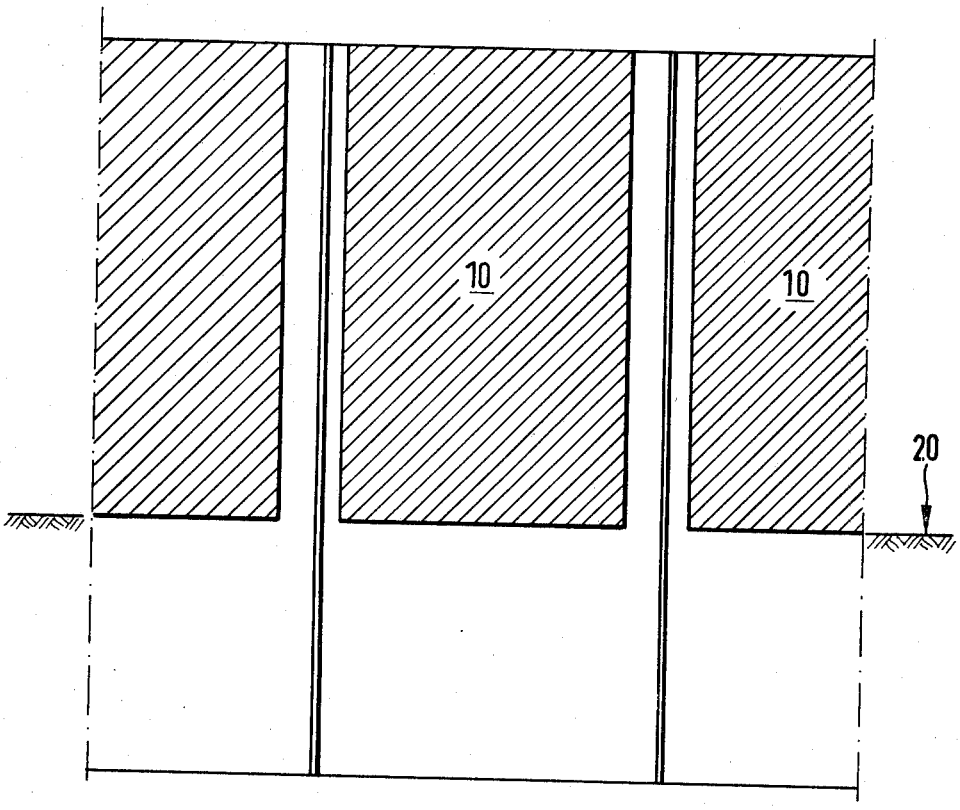
Figure 4:
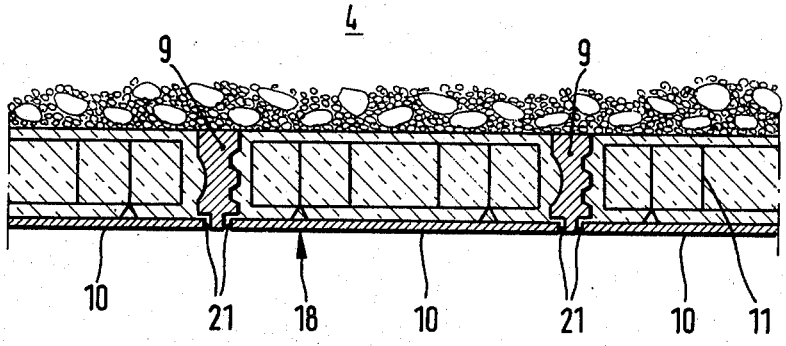
Figure 5:
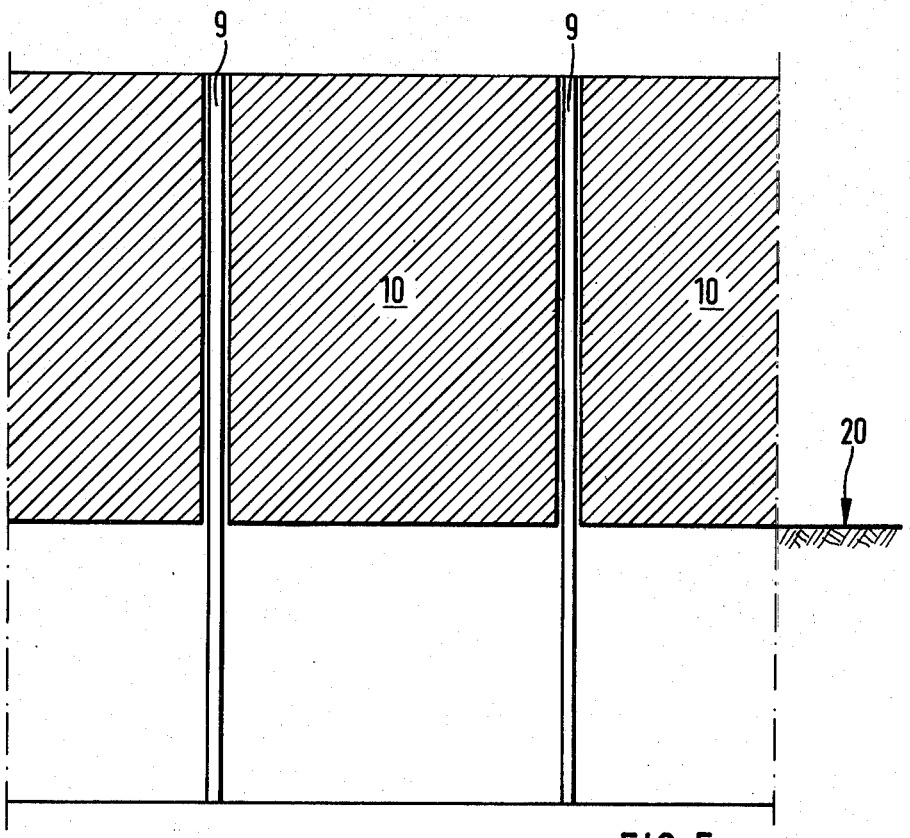
Figure 6:
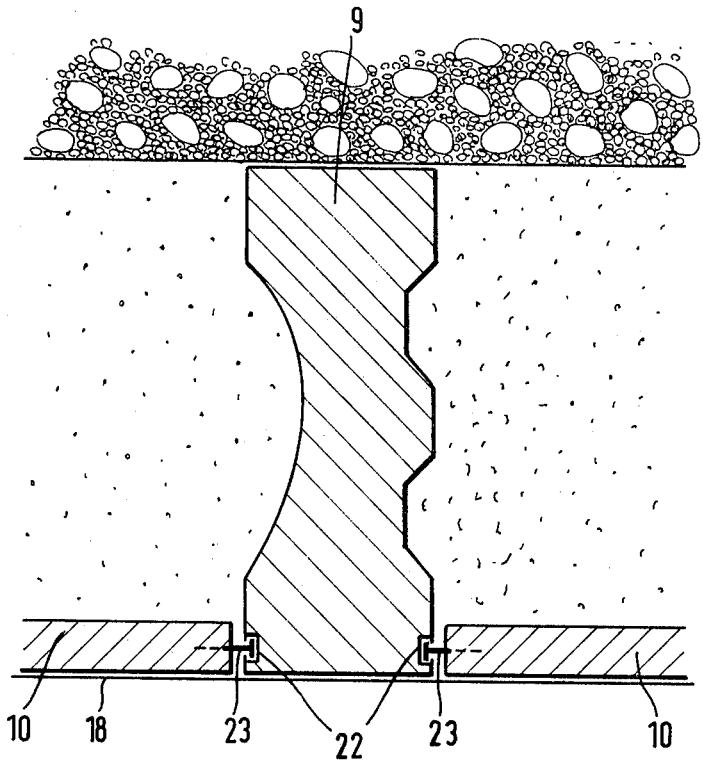

Preferred embodiments of the invention shall now be described with reference to the accompanying drawings. wherein:

FIG. 1 shows a perspective view of a construction site with two trench walls under construction, FIG. 2 shows a sectional view of a trench wall erected by the method according to the invention, FIG. 3 shows a view of the exposed surface of the trench wall of FIG. 2, FIG. 4 shows a sectional view of a trench wall in another embodiment of the invention, FIG. 5 shows a view of the exposed surface of the trench wall of FIG. 4, and FIG. 6 shows a sectional view of two plates guided in a partition element.

The performance of the method according to the invention is diagrammatically shown in FIG. 1. The contours of the trench walls to be erected are initially established by erecting guide walls 1 in a known manner. Guide walls 1 serve to guide the trenching bucket 2 of an excavator 3 employed for excavating a trench 5 of adequate depth, width and length for the subsequent erection of a trench wall in soil 4. A chisel 6 also employed for this operation serves to finish the trench walls and to loosen or brake up solid rock formations.

As excavation of the trench proceeds, a shore-up fluid 7 is introduced thereinto for pressure compensation along the trench walls to prevent slippage thereof. In the present case, a clay suspension employed as the shore-up fluid is introduced into the trench by means of a hose 8. In the case of difficult geological conditions, such as in the presence of gravel, the shore-up fluid is not always able, however, to prevent parts of the trench walls from slipping, resulting in the formation of cavities and thus in uneven surfaces of the finished trench wall.

After the trench has been excavated to the desired depth, it is divided into individual sections by means of vertical partition elements 9 extending down to the trench bottom. In the embodiment shown, the partition elements are in the form of hollow profile tubes of conventional construction. In a further step of the method shown, prefabricated, thin-walled concrete plates 10 are fixedly attached to one side of a reinforcement cage 11 preparatory to being lowered into the trench together therewith. FIG. 1 shows only two plates 10 attached side-by-side to reinforcement cage 11. In practice, however, the reinforcement cage may be provided with such plates over its entire height.

If, on the other hand, the trench is unstable only at a determined depth, it is possible to provide plates 10 only at the respective level in order to obtain a smooth exposed surface of the finished trench wall.

It is also possible to lower the plates 10 to their installation site within the trench independently of a reinforcement cage or any other reinforcement. In any case the plates are located adjacent the later exposed side or sides of the finished trench wall. After the plates have been lowered and aligned at their installation site and any required reinforcement has been installed in the trench, the latter can now be filled with in-situ concrete as shown at the right in FIG. 1. An excavator 12 carries a filling chute 13 extending down to the trench bottom, and a concrete mixer vehicle 14 empties the ready-mixed, concrete into the chute. In this manner the trench is filled with the in-situ concrete from bottom to top between the rear side of the plates and the opposite trench wall.

As the introduction of the in-situ concrete into the trench proceeds, the shore-up fluid 7 is transferred to a reservoir 16 by means of a pump 15.

In this manner the trench wall is finished proceeding from one section to the next. After the concrete has set, the partition tubes are withdrawn as by means of an excavator shown at 17. The resulting cavities are subsequently filled with in-situ concrete to finish the trench wall.

After finishing of the two parallel trench walls shown in FIG. 1, the soil 4 contained therebetween may be excavated to expose the inwardly facing sides of the trench walls to the view. Any concrete leaked through the interstices between adjacent plates 10 can be readily removed. In the case of inaccurately excavated trenches or of slippage in the trench walls, the plates 10 will have prevented the in-situ concrete from penetrating into any resulting cavitites and necessitating extended finishing work for obtaining a smooth surface.

FIG. 2 shows a sectional view of a trench wall according to the invention. An exposed side 18 of the wall is formed by plates 10 in side-by-side arrangment. At their rearward sides plates 10 are connected to reinforcement cage 11. Ground 4 is seen at the rear of the wall. The semicircular ends 19 of the trench wall sections are formed by the partition tubes shown in FIG. 1. In the example shown, the partition tubes had been removed only after filling of a section with concrete and the setting thereof and prior to filling of the succeeding section. This explains the semicircular shape of the ends 19 of the sections. FIG. 3 shows a front view of the exposed surface of the finished trench wall. The plates 10 embedded in the in-situ concrete extend down to the bottom 20 of an excavation. No plates are provided below bottom 20, inasmuch as this portion of the trench wall is not open to the view.

In FIGS. 4 and 5, the tubular partitions are replaced by different partition elements 9 in the form of prefabricated concrete elements having substantially rectangular cross-section. Partition elements 9 are vertically installed in the excavated trench in the same manner as the tubular partitions. As different thereform, however, they are left in the trench to form components of the finished trench wall. Adjacent both corners of the shorter side facing towards the later exposed surface, the partition elements are provided with guides 21 for plates 10. In the example shown the guides are in the form of grooves extending over the full length of the partition elements. The depth of grooves 21 is substantially equal to the thickness of plates 10. The trench wall is erected by initially lowering the partition elements into the trench and positioning them therein.

Subsequently the plates may be lowered along guides 21 either as a unit together with the reinforcement cage or by themselves, down to the proper depth.

In this embodiment, the in-situ concrete is reliably prevented from leaking through the joints between the partition elements and plates.

The same is valid for the embodiment shown in FIG. 6, in which the partition elements are provided with profile members 22 for guiding the plates adjacent both corners of the shorter side of their rectangular cross-section facing towards the later exposed side 18. The profile members are embedded in the partition elements and extend over the full length thereof. They are shaped for instance of metal and have rectangular cross-sectional configuration, with a longitudinal slot extending along one side thereof. The plates are lockingly engaged with the profile members via T-section engagement members 23. During installation, engagement members 23 are introduced into profile members 22 to be guided therein during lowering of the plates. Engagement members 23 may also be in the form of profile members extending the length of plates 10 for obtaining a sealed connection between the partition elements and plates.

We claim:

1. A method for constructing a trench wall having a finished exposed surface comprising the steps of:

excavating a trench in the soil;

simultaneously filling said trench with a shore-up fluid;

inserting a pair of spaced apart vertical partition elements having guide means thereon in said trench;

engaging the ends of a prefabricated plate with said guide means and guiding said plate downward between said vertical partition elements at the side of the trench wall which is later to be exposed by removing the soil;

introducing in-situ concrete into the space between said plate and the other side of said trench and between said vertical partition elements and thereby displacing said shore-up fluid;

allowing said in-situ concrete to harden and adhere to said plate and to said vertical partition elements;

and removing the soil to expose the plate and the associated vertical partition elements.

2. A method according to claim 1 further including the step of locating reinforcement structure in said trench between said plate and the other side of said trench.

3. A method according to claim 2 wherein said plate and said reinforcing structure are interconnected and simultaneously guided vertically into said trench.

4. In a trench wall section, in combination:

a pair of vertically disposed laterally spaced apart partition elements;

a body of concrete disposed between and adhering to said pair of partition elements;

an exposed prefabricated plate disposed between and connected to said pair of partition elements and adhering to one side of said body of concrete;

and means on each of said partition elements and engaged with the ends of said plate, said means serving to guide said plate as the latter is lowered in place during fabrication of said trench wall section and serving to mechanically support said plate when the latter is in place, said means comprising a vertically disposed groove formed on a side of said partition element.

5. A combination according to claim 4 wherein said plate is provided with a member which slidably engageable with said groove.

* * * * *